United States Patent [19]

Silverman

[11] Patent Number: 4,834,188

[45] **Date of Patent: * May 30, 1989**

[54] FIRE EXTINGUISHING SYSTEM FOR COOKSTOVES AND RANGES

[75] Inventor: Robert R. Silverman, Panama City, Fla.

[73] Assignee: Twenty-First Century International Fire Equipment and Services Corp., Irving, Tex.

[ * ] Notice: The portion of the term of this patent subsequent to Sep. 27, 2005 has been disclaimed.

[21] Appl. No.: 172,522

[22] Filed: Mar. 24, 1988

Related U.S. Application Data

[63] Continuation-in-part of Ser. No. 27,919, Mar. 19, 1987, Pat. No. 4,773,485.

[51] Int. Cl.[4] ..... A62C 35/14

[52] U.S. Cl. ..... 169/65; 169/51; 169/59; 169/61; 126/299 R

[58] Field of Search ..... 169/65, 47, 51, 54, 169/57, 59, 60, 61, 19, 42, DIG. 3; 126/299 R

[56] References Cited

U.S. PATENT DOCUMENTS

| | | | |
|---|---|---|---|
| 782,903 | 2/1905 | Morell | 169/54 X |
| 3,448,808 | 6/1969 | Scofield et al. | 169/19 X |
| 3,463,233 | 8/1969 | Haessler | 169/47 |
| 3,584,688 | 6/1971 | Duncan et al. | 169/47 |
| 3,653,443 | 4/1972 | Dockery | 169/61 |
| 3,772,499 | 11/1973 | Fritzsche | 169/65 X |
| 3,824,374 | 7/1974 | Mayher | 169/65 X |
| 4,256,181 | 3/1981 | Searcy | 169/65 |
| 4,356,870 | 11/1982 | Gaylord et al. | 126/299 R |
| 4,580,638 | 4/1986 | Jones et al. | 169/59 X |

*Primary Examiner*—Sherman D. Basinger
*Assistant Examiner*—Paul E. Salmon
*Attorney, Agent, or Firm*—Millen & White

[57] ABSTRACT

A fire extinguishing system for a cookstove or range includes a fire extinguisher mounted above a hood positioned over the cookstove or range. The fire extinguisher is connected to a pair of nozzles within the hood to dispense fire suppressant over the cookstove or range. The fire extinguisher includes an operator normally biased to the operable position, but held in the inoperable position by a cable having a plurality of fusible links distributed therein. The cable is held in tension adjacent the inner periphery of the hood. Upon the occurrence of a fire, at least one of the links separates, releasing the cable and allowing the operator to move to the operating position whereby the fire extinguisher releases the fire suppressant. A low-voltage control circuit is used to cut off the flow of electricity or gas to the stove and to sound an alarm. A battery is provided with the low-voltage control circuit so that the system will still operate if house current is interrupted.

19 Claims, 2 Drawing Sheets

80
81
32
33
35
29
31
84
77
78
85
37
136
30
38
22
82
46
14
C
52
47
21
12
51
49
16
74
48
71
76
54
41
75
57
56
43
39
18
19
A
59
73
D
70
40
58
69
68
17
61
60
42
63
64
66
11
13
10
B
13
11
11

FIRE EXTINGUISHING SYSTEM FOR COOKSTOVES AND RANGES

RELATED APPLICATIONS

This application is a continuation-in-part of U.S. patent application Ser. No. 027,919 filed Mar. 19, 1987 now U.S. Pat. No. 4,773,485, filed 9/27/88.

BACKGROUND OF THE INVENTION

This invention relates to an automatically operated fire extinguishing system which can be used for both electrical and gas residential cookstoves or ranges. More particularly the invention concerns such a system which is mounted in a hood positioned over the stove or range.

Until relatively recently, automatic fire extinguishing systems for use with residential cookstoves a have generally been concerned with extinguishing fires caused by fat burning in a commercial grease pot or kettle. Generally, the systems were solely concerned with extinguishing the fire. No provision was made for turning off electrical and gas burners of the stove. Consequently, the fire extinguishing system would extinguish the lighted burners of a gas stove while allowing the gas to continue flowing. This created the very hazardous condition of allowing unburned gas to flow from the burners. This, of course, created a situation in which a residence could fill with gas to dangerous levels and then explode. Or perhaps, on the other hand, the residents were exposed to the hazard of being asphyxiated by gas fumes. If the system is used with an electric stove, the burners could reignite spilled grease and fat once the fire extinguishing foam had dissipated. Moreover, these arrangements had no, provision for sounding an alarm or deenergize associated exhaust equipment.

U.S. Pat. No. 3,653,443 recognized the aforementioned difficulties with the prior art and provided a system for shutting off the stove, operating an alarm and deenergize exhaust fans. To the knowledge of the instant inventor, the concepts set forth in U.S. Pat. No. 3,653,443 have never been commercialized. The particular arrangement set forth in this patent has apparently not been commercialized because of the expense and difficulty in combining the concept of this patent with existing residential hood configurations. In other words, the particular structure disclosed in this patent is not readily retrofittable on existing stoves and stove hoods.

The prior art discloses numerous arrangements for automatically extinguishing stove fires. U.S. Pat. No. 4,256,181 discloses a fire extinguisher in combination with a hood. However, this patent requires a tube for conducting heat from the stove to a mechanism for operating the fire extinguisher. The operating mechanism includes a flammable fuel which generates heat in a hood above the stove making the operating system itself a fire hazard. The foam from the extinguisher is dispensed on the stove.

Other patents, such U.S. Pat. Nos. 4,580,638; 3,584,688 and 3,448,808 and 3,824,374 each disclose arrangements of cables and fusible links. However, these arrangements are not configured in a fashion which is readily adaptable to retrofitting in existing stove hoods or existing stove configurations. These arrangements are more suitable for commercial kitchens than residential kitchens.

In order for an automatic fire extinguishing system to be widely used in home kitchens, it is necessary for the system to be configured so that any home owner or resident with minimal mechanical skills can install the system. Ordinarily, household fire warning equipment designed to be installed by other than a qualified electrician cannot be powered from a source having a voltage in excess of 30 volts. Accordingly, in order to avoid the need for a qualified electrician, stove fire extinguishing systems must operate on less than 30 volts. None of the systems currently available meet this requirement, since they all require house line current.

If a range utilizes gas as a fuel and electric power to the house is interrupted, the systems currently available will not function properly during a power outage, since there is no power available to control the flow of gas to the gas burners. Accordingly, a very dangerous situation arises if there is a power outage during which a stove fire is extinguished, but gas continues to flow through the burners. The gas in and of itself can asphyxiate people in the house or can accumulate and explode when the electricity comes back on and generates a miscellaneous spark at a location in the house where gas has accumulated. The systems of the prior art do not protect residences in this particular situation.

SUMMARY OF THE INVENTION

It is an object of the instant invention to provide a new and improved system for extinguishing fires on cookstoves and ranges wherein the system is automatic and is readily retrofittable to existing residential stove hoods.

Upon further study of the specification and appended claims, further objects and advantages of this invention will become apparent to those skilled in the art.

In view of the aforementioned object, and other objects, the instant invention contemplates a fire extinguishing system for cookstoves and ranges wherein the fire extinguishing system is mounted within and adjacent to a hood which is positioned over the stove or range. The system comprises a fire extinguisher having an operator biased to a first position in which the fire extinguisher releases a fire extinguishing substance and retained in a second position in which the fire extinguisher retains the fire extinguishing substance. A cable is attached to the operator of the fire extinguisher for holding the operator in the second position. The cable is trained around a substantial portion of the inner periphery of the hood and the distal end of the cable is anchored on the hood. A plurality of fusible links are disposed within the cable and distributed around the hood wherein, when there is a fire on the stove or range, at least one of the fusible links will separate, releasing the cable to allow the operator to move from the second position to the first position and thereby release the fire extinguishing substance onto the stove top.

Connected to the fire extinguisher is a detector which detects when the fire extinguisher begins to operate. Connected to the detector is a shut-off mechanism which shuts-off electrical power or gas to the stove and if desired deenergize a fan in the hood. An alarm in the house and/or at a remote location such as a fire station may be sounded. The various electrical elements are powered from a low-voltage source so that the system may be installed by a homeowner with minimal expense.

DETAILED DESCRIPTION

Figure 1:
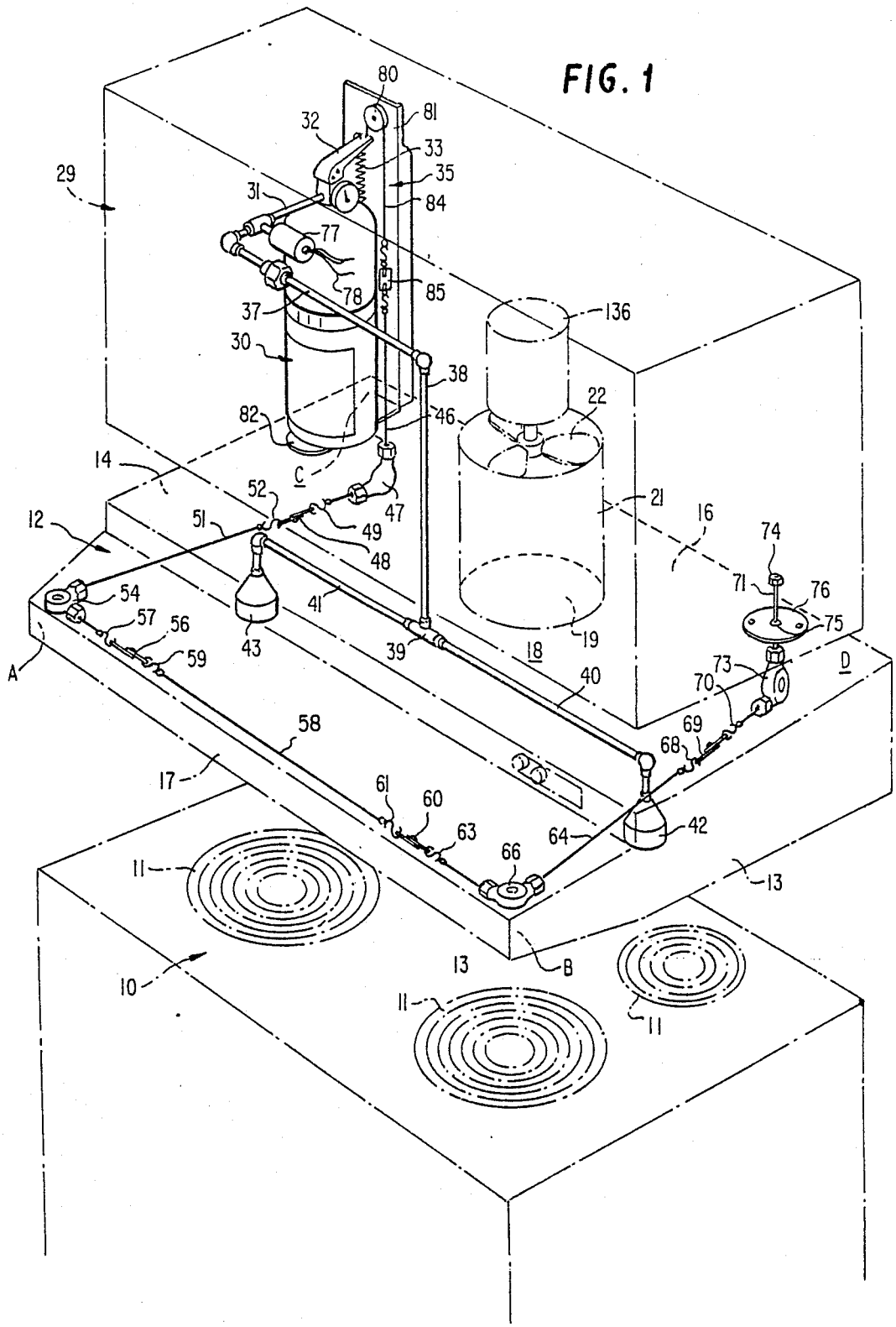
FIG. 1 is a perspective view of a fire extinguishing system configured in accordance with the principles of the instant invention.

Referring now to FIG. 1 there is shown a stove or range, designated generally by the numeral 10, which includes a plurality of burners 11. The stove or range 10 is the type used in a private residence. Positioned over the stove or range 10 is a conventional hood, designated generally by the numeral 12. The hood 12 has a pair of side walls 13 and 14, a rear wall 16, a front wall 17 and a top surface 18 and has corresponding first and second front corners A and B and first and second rear corners C and D. The hood 12 has an opening 19, preferably through the top surface 18 thereof which is attached to a duct 21 having an exhaust fan 22 therein for forcibly evacuating fumes and vapor which collect in the hood while cooking on the stove 10.

In accordance with the principles of the instant invention, a fire extinguisher, designated generally by the numeral 30, is positioned adjacent to, and preferably over the hood 12 in a cabinet 29, schematically illustrated by a broken line. The fire extinguisher 30 is a conventional extinguisher and may dispense either a liquid or dry fire suppressant material. In accordance with the preferred embodiment of the invention, the extinguishing agent is a dry chemical agent. For residential use, the chemical agent is 4.5 pounds by weight and made according to a formulation that is designed for rapid flame knockdown and securement of cooking grease-related fires. The agent discharge time is at least fifteen to thirty seconds to insure fire extinguishment and eliminate flashback. The discharge rate is gentle enough to avoid splattering of burning grease. The fire extinguisher 30 has an outlet 31 through which the fire suppressant material flows under pressure upon moving operating lever 32 downwardly. In accordance with the principles of the instant invention, the operating lever 32 is attached to a coil spring 33 which is under tension. The coil spring 33 biases the operating lever 32 downwardly so as to eject fire suppressant material through the outlet 31. As will be explained more fully hereinafter, the operating lever 32 is held in a first, non-operating position by tension on a cable, designated generally by numeral 35. Upon release of the tension on the cable 35, the operating lever 32 moves to a second position as the spring 33 contracts and the material moves out through the nozzle 31, through a horizontal pipe 37 and down a vertical pipe 38 inside the hood 12 to a T-joint 39. The T-joint 39 is connected to a pair of horizontal pipes 40 and 41 extending toward the side walls 13 and 14 of the hood respectively. At the end of each of the pipes 40 and 41 are nozzles 42 and 43, respectively, through which the fire suppressant material expands and covers the top of the stove or range 10 putting out any fire thereon.

The cable 35, which holds the operating handle 32 in the first position against the bias of spring 33, is looped over a first pulley 38 journaled on a mounting bracket 39 which supports the fire extinguisher 30 on a shelf 41. The bracket 39 is rigidly attached to a wall of the cabinet 29 or to some other surface which is in fixed relation to the hood 12. The cable 35 has a first section 43 which is attached to a turnbuckle 44 that allows adjustment of the cable. A second section of the cable 46 is attached to the other end of the turnbuckle and is trained around a pulley 47 that is secured to the underside of the top 18 of the hood 12 which has a hole therethrough through which the second section 46 of the cable passes. The second section of the cable 46 exits from the pulley 47 at a right angle to the direction in which it entered the pulley and extends a distance horizontally within the hood 12 generally parallel to the side 14 of the hood. A first fusible link 48 is attached to the second length of cable 46 by an S-hook 49. The other end of the fusible link 48 is attached to a third length of cable 51 by a second S-hook 52. The third length of cable 51 is trained around a second pulley 54 in the first front corner A of the hood and emerges adjacent the front wall 17 of the hood where it is connected to a second fusible link 56 by an S-hook 57. The second fusible link 56 is connected to a fourth length of cable 58 by an S-hook 59 which extends behind the front wall 17 a distance to a fourth heat fusible link 60 to which it is connected by an S-hook 61. A fifth length of cable 64 is attached by an S-hook 63 to the fusible link 60 and extends around a third pulley 66 so as to extend along behind the side wall 13 of the hood 12. The fifth cable 64 is connected by S-hook 68 to a fourth fusible length 69 and by S-hook 70 to a sixth length of cable 71. The sixth length of cable 71 is trained around a fourth pulley 73 and emerges through the top wall 18 of the hood 12 where it is secured to a stop 74. The stop 74 prevents the fifth cable section 71 from sliding through a hole 75 in a flange 76 which is positioned on the top surface of the top 18 of hood 12. The cable 35 and fusible links are not enclosed in conduits or housings but are exposed. However, the cable and links are ordinarily concealed from view because they are within the hood structure.

The fire extinguishing system in accordance with the principles of the instant invention may be installed by the average homeowner using existing tools. First, the fire extinguisher 30 is placed above the hood 12, preferably in a cabinet 29. The piping for carrying fire suppressant is then passed through the bottom of the cabinet 29 and the top 18 of the hood 12. The T-joint 39 is connected to the vertical pipe 38 and the horizontally extending pipes 40 and 41 are screwed into the T-joint. The horizontally extending pipes may be stiff enough to be cantilevered from the T-joint 39 or may perhaps be supported at their ends adjacent the nozzles 42 and 43. The nozzles 42 and 43 are then screwed into elbows attached to the ends of the horizontal pipes 40 and 41.

After the piping is installed, cable 35 is strung through the system by sequentially attaching the fusible links 48, 56, 60, and 69 with the various S-hooks. The portion of the fifth cable section 71 which extends through plate 75 is then secured by fixing the stop 74 to the end of the fifth cable section. The turnbuckle 44 is then shortened to take up any slack in the cable 35 and to tension the cable. Spring 33 is then anchored to the bracket 39 at one end and stretched to reach and overlie the handle 32 so as to bias the handle 32 in a downward direction toward the second position. Tension in cable 35 retains the handle 32 in the first position. The fire extinguishing system is now set to automatically operate upon the occurrence of a fire on the stove 10.

When there is a fire on the stove, the fire will melt the solder or other material fusing the halves of at least one of the links 48, 56, 60 and 69 together. As soon as one of the links separates due to heat from the fire, the cable 35 will no longer be tensioned and spring 33 will move the handle 32 from its first position to its second position, causing the extinguisher 30 to release the fire suppressant chemicals therein. The extinguisher 30 will continue to operate until the fire suppressant chemical is exhausted.

If there is no one present when the fire occurs, to turn off the burners 11 on the stove 10, the dangerous condition which caused the fire in the first place can resume without there being any further provision for putting out a subsequent fire. Since discharging the fire extinguisher 30 does not automatically turn off the source of heat which started the fire initially, the burners 11, if they are electrical burners, will continue to generate heat. After a while, the grease which remains on the stove 10 may again reignite. Since the fire extinguishing system is a one-shot arrangement, the subsequent fire cannot be extinguished by the system. If the burners 11 are gas burners, the fire suppressant will extinguish the burners; however, the gas for energizing the burners will continue to enter the stove and pour into the room without burning. This accumulation of gas could result in a subsequent explosion or could asphyxiate people in the residence where the stove 10 is located.

In order to prevent the occurrence of these situations, the pipe 31 leading from the fire extinguisher is equipped with a micro switch 77 which detects when the extinguisher 30 discharges. Micro switch 77 is connected by leads 78 to the circuit of FIG. 2. Switch 77 is preferably a microswitch and is connected to a 12-volt circuit, designated generally by the numeral 100. As will be explained more specifically hereinafter, the microswitch 77 operates either a gas valve 101 or electrical switch 102 via a 12-volt solenoid 103 to shut off the supply of electricity or gas when the microswitch 77 detects a discharge by the fire extinguisher 30.

The circuit 100 is connected to 120-volt/60-hz house current through a plug-in-type transformer 107 which is connected by leads 108 and 109 to a power supply/battery charger 110. An indicator LED 111 indicates that power is flowing through to the power supply and battery charger 110. A 12-volt battery 112 is connected by leads 113 and 114 to the power supply/battery charger and provides 12-volt power to the system in situations wherein the available house current has been interrupted for one reason or another.

The power supply/battery charger 110 has its positive pin connected to a 12-volt relay 115 via line 116 which is connected to both the positive pin on the relay and to one of the closed contacts on the relay. The line 117 from the negative pin of the power supply/battery charger 110 is connected to various other components of the system, while a second LED 119 indicates that the power supply is providing its output. Line 117 is connected to a normally open contact on the microswitch 77 and to the negative pole of the solenoid 101, as well as the normally open contact of the 12-volt relay 115 via line 120 and the alarm circuit elements, designated generally by the numeral 121. The solenoid 101 has its positive pole connected to a normally open contact on the 12-volt relay 115, while the microswitch 77 has its closed contact connected to the negative pole of the 12-volt relay and its normally closed contact connected to the normally closed contact on the 12-volt relay. Upon an increase in pressure in line 31, the microswitch 77 opens its normally closed contact and closes its normally open contact which causes the 12-volt relay 115 to open its normally closed contact on the negative side and to close its normally open contact on the negative side, while closing its normally open contact on the positive side. This causes 12-volt direct current to flow through lines 117 and 122 so as to activate the solenoid 101 and either close the associated gas valve 101 or open the associated electrical switch 102, thus interrupting gas or electricity which might reignite the fire subsequent to the fire being initially extinguished by discharge of the fire extinguisher 30.

Upon operation of the microswitch 77, the microswitch also energizes horn 127 and optional strobe light 126 in the alarm circuit 121 by closing the normally open contact in 12-volt relay 115 so that current flows through line 117 and through line 124 to energize the horn 126 and power the strobe light 127. The horn 126, of course, alerts the household that there is a fire while warning people to leave the house while at the same time identifying the particular source of the fire. The horn silence switch allows one to shut the horn off after the conflagration has ceased.

Reset switch 130 is connected via line 124 to the closed contact of the 12-volt relay and by line 131 to the closed contact of microswitch 77 and negative pin of the 12-volt relay. The reset switch 130 has normally closed contacts which open upon operation of the microswitch 77. In order to reset the system, the open contacts are closed by pressing a button on the reset switch.

After a fire has occurred, it is necessary to recharge or replace the fire extinguisher 30, and replace the broken links in the cable and linkage network.

The use of the low voltage circuit 100 eliminates the unsightly hard wire and rigid metal conduit necessary with ordinary line current systems and deletes the necessity of having to relight the pilot flame on gas supplied stoves. This is accomplished by maintaining electrical energy with power from a back-up battery to a gas solenoid valve, back-up power 112 is available from one to six hours.

Figure 2:
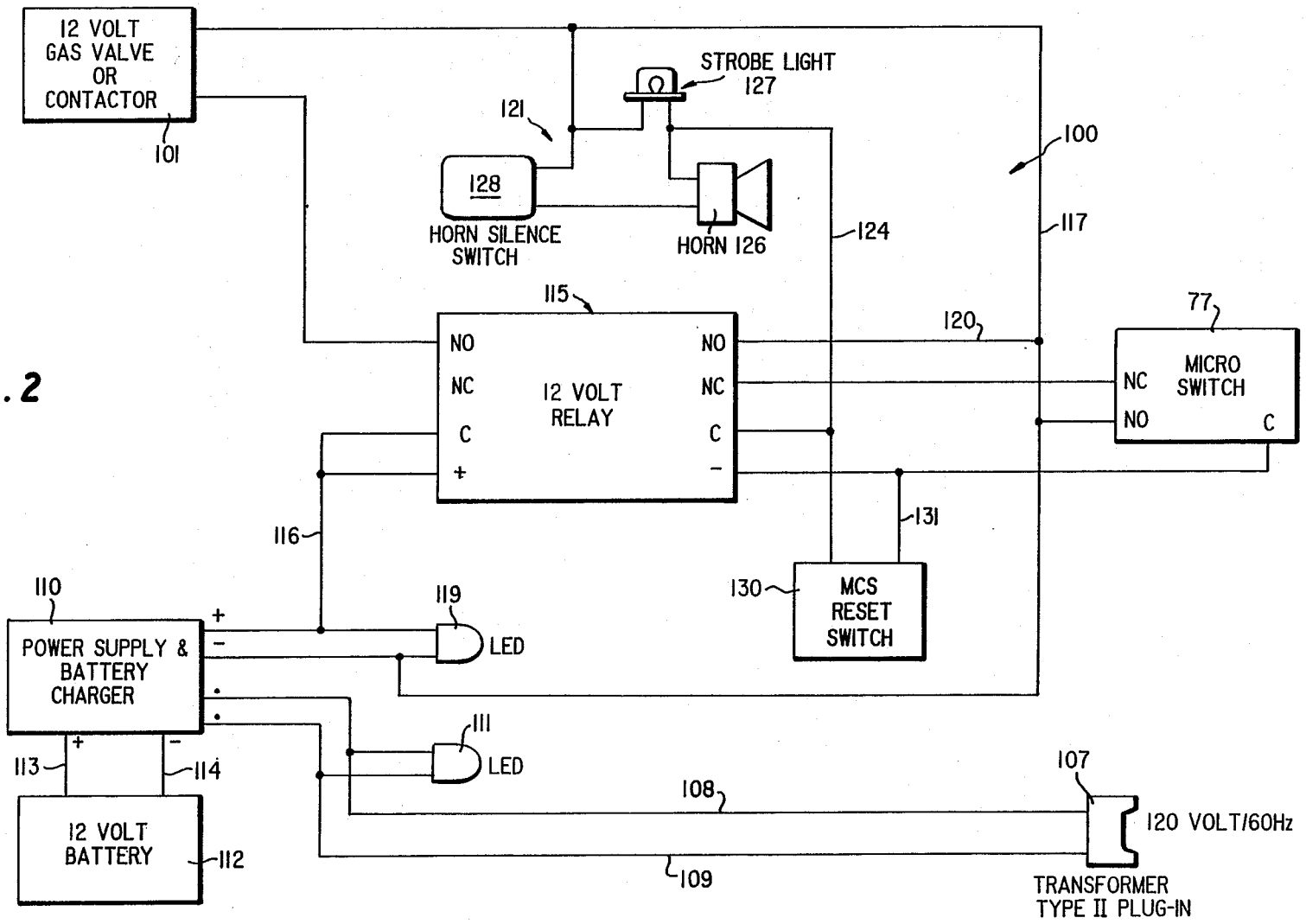
FIG. 2 is a circuit diagram showing a low-voltage power supply circuit used in combination with the fire extinguishing system of FIG. 1.

The circuit 100 of FIG. 2 was fabricated utilizing the following circuit components:

101. Gas solenoid valve or electrical contactor (12 Volt
   Supplier: ASCO (gas valve, pipe sizes $\frac{1}{4}''$-$\frac{1}{2}''$-$\frac{3}{4}''$)
   Supplier: POTTER AND BRUMFIELD (electrical contactor, rating 40A FL/50A Res. and 50A FL/60A Res.)
102. Strobe Light (12 Volt DC).
   Supplier: Tandy Corporation (Radio Shack) or Amseco, Inc.
126. Horn (4–24 Volt DC), 85 db @10′ or 90 db @10′ or 100 db @10″, dual tone-pulsed or steady.
   Supplier: Tandy Corporation (Radio Shack) or Moose Corporation.
128. Horn Silence Switch, general purpose 125 V AC/DC 3A one or two pole Toggle Switch with On/Off name plate.
   Supplier: Tandy Corporation (Radio Shack) or EATON Cutler-Hammer or other listed switch.
115. Relay, double pole/double throw, Rated 3A @125 VAC, 12 V Coil and relay socket with retaining clip mounted on circuit board.
   Supplier: Tandy Corporation (Radio Shack) or Alarm Controls Corporation or Twenty First Century Int'l Fire & Svcs Corporation or SPC Technology or Potter and Brumfield.

77. Miniature Snap-Action (Micro Switch), Rated 10A @125/250 VAC, ¼Hp, with phenolic case and coil spring mechanism.
Supplier: Cherry Electric Product Corporation or Unimax Switch Corporation.

107. Transformer, Class II type plug-in with 120 Volt 60 Hz AC primary, 12 Volt, 20 VA or 18 Volt, 20 VA or 18 Volt, 35 VA with machine screw for securing to 120 VAC standard wall receptacle.
Supplier: Moose or other UL Listed having equal specifications.

130. Miniature Push Button Switch, momentary SPST Contacts (Normally Closed) rated 0.5A @125 VAC.
Supplier: Tandy Corporation (Radio Shack) or other having equal specifications.

111. Light-Emitting Diode (LED), green, power dissipation and 75 mW, forward current 25 mA, luminous
119. intensity 6.3 mcd, also, 1K ½W resister added to Cathode (−minus) lead.
Supplier: Tandy Corporation (Radio Shack) or other having equal specifications.

110. Power Supply and Battery Charger, regulated DC output selectable for 6.9 or 13.8 volts, 4A self restoring circuit breaker, 1A continuous output wit 0.2 volt ripple. Where less output is required, other power supply and battery charger to be used shall have 3A fused circuit 13.8 VDC at 600 milliamps continuous output.
Supplier: Moose or other having equal specifications.

112. Battery, 1.2 AH, 12 volt or 4 AH, 12 volt, sealed lead acid rechargeable.
Supplier: Yuasa, Moose, PowerSonic, or other having equal specifications.

The preceding examples can be repeated with similar success by substituting the generically or specifically described components for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A system for extinguishing stove top fires which occur on stoves that have burners, the system comprising in combination:

a hood having a top wall, first and second side walls, a front wall and a rear wall; the walls joining at first and second front corners and first and second rear corners;

nozzle means positioned within the hood and facing the stove;

fire extinguisher means connected to the nozzle means for dispensing fire suppressant material through the nozzle means;

means for operating the fire extinguisher means and means for biasing the operating means to a first position which causes the fire extinguisher to discharge the fire suppressant;

means for holding the operating means in a second position against the bias of the biasing means, wherein when the operating means is in the second position, the fire extinguishing means is prevented from discharging;

the means for holding the operating means in the second position including a cable means segmented in a plurality of sections, each section being connected to adjacent sections by fusible links;

cable support means positioned inside of the hood for training the cable means around the inside of the hood, the cable support means including a first cable support proximate the rear wall and adjacent to the first rear corner thereof, a second cable support proximate the front wall and adjacent the first front corner thereof, a third cable support proximate the front wall and adjacent the second front corner thereof and a fourth cable support proximate the rear wall and adjacent the second rear corner thereof; the cable means being free to move over at least three of the cable supports when unrestrained and being trained around the pulleys, and means for anchoring the cable means proximate the rear wall and adjacent the second rear corner of the hood, wherein the cable means is held in tension around the inner periphery of the hood to hold the operating means in the second position whereby when there is a fire on the stove top at least one of the fusible links separates, releasing tension on the cable and allowing the operator to move from the second position to the first position under the bias of the biasing means.

2. The system of claim 1 wherein the cable means includes means therein for adjusting the length thereof.

3. The system of claim 1 wherein there is a pressure sensor connected to the outlet of the fire extinguisher means for detecting release of the fire suppressant and thus the occurrence of a fire, the pressure sensor being connected to a circuit, which circuit includes means for interrupting the flow of energy from energizing means to the burners or heaters of the stove.

4. The system of claim 3 wherein the circuit also includes an alarm means for indicating an occurrence of a fire.

5. The system of claim 3 wherein the hood includes exhaust fan means and the circuit includes means for activating the exhaust fan means to prevent flame propagation generated by a fire.

6. The system of claim 3 wherein the circuit further includes a low-voltage power supply and battery charger and means for plugging the power supply and battery charger into house current; a battery connected to the power supply and battery charger for supplying power to the circuit upon interruption of power provided to the power supply and battery charger by the house current.

7. The system of claim 6 wherein the battery is a 12-volt battery and the power supply provides the circuit with current at approximately twelve volts.

8. The system of claim 6 further including means connected to the power supply and battery for controlling the pilot light of a gas stove which may otherwise be unintentionally extinguished.

9. The system of claim 6 wherein the pressure switch is connected to the circuit through a low-voltage relay which relay is connected to the means for interrupting the flow of energy from the energizing means to the burners of the stove, the relay allowing current to flow to the energy interrupting means from the power supply upon being activated by the pressure switch.

10. The system of claim 6 further including alarm means for emitting a signal indicative of a fire, the alarm means being connected to the relay through the pressure switch so as to sound upon activation of the pressure switch.

11. The system of claim 10 wherein the alarm means includes a strobe light.

12. The system of claim 6 further including a first visual indicator connected between the power supply/-battery charger and the house current plug for indicating that house current is flowing to the power supply and a second visual indicator connected between the power supply/battery charger and the rest of the circuit for indicating that low-voltage current is available from the power supply battery charger.

13. The system of claim 6 further including a reset switch for resetting the circuit after operation of the system to extinguish a fire and after the system has been recharged and restrung.

14. The system of claim 1 wherein the fire extinguisher means is mounted above the hood.

15. The system of claim 1 wherein the fire suppressant material is a dry chemical agent.

16. The system of claim 1 wherein the fire suppressant material is a liquid agent.

17. A system of claim 1 wherein the means for anchoring the cable means is positioned outside of the hood above the top thereof.

18. A system of claim 1 wherein the cable supports are pulleys.

19. A system of claim 1 wherein the cable supports are pulleys and wherein the means for anchoring the cable support means is positioned outside of the hood on the top surface of the hood.

* * * * *

US004834188B1

REEXAMINATION CERTIFICATE (1888th)

United States Patent [19]

Silverman

[11] B1 4,834,188

[45] Certificate Issued Dec. 22, 1992

[54] FIRE EXTINGUISHING SYSTEM FOR COOKSTOVE AND RANGES

[75] Inventor: Robert R. Silverman, Panama City, Fla.

[73] Assignee: Twenty-First Century International Fire Equipment and Services Corp.

Reexamination Request:
No. 90/002,109, Aug. 14, 1990

Reexamination Certificate for:

| | |
|---|---|
| Patent No.: | **4,834,188** |
| Issued: | **May 30, 1989** |
| Appl. No.: | **172,522** |
| Filed: | **Mar. 24, 1988** |

Related U.S. Application Data

[63] Continuation-in-part of Ser. No. 27,919, Mar. 19, 1987, Pat. No. 4,773,485.

[51] Int. Cl.[5] ..... A62C 35/00

[52] U.S. Cl. ..... 169/65; 169/51; 169/59; 169/61; 126/299 R

[58] Field of Search ..... 169/65, 47, 51, 54, 169/57, 42, 59–61, 19, DIG. 3; 126/299 R

[56] References Cited

U.S. PATENT DOCUMENTS

| | | | |
|---|---|---|---|
| 782,903 | 2/1902 | Morell | 169/54 X |
| 3,448,808 | 6/1969 | Scofield et al. | 169/19 X |
| 3,463,233 | 8/1969 | Haessler | 169/47 |
| 3,584,688 | 6/1971 | Duncan et al. | 169/47 |
| 3,653,443 | 4/1972 | Dockery | 169/61 |
| 3,772,499 | 11/1973 | Fritzsche | 169/65 X |
| 3,824,374 | 7/1974 | Mayher | 169/65 X |
| 4,256,181 | 3/1981 | Searcy | 169/65 |
| 4,356,870 | 11/1982 | Gaylord et al. | 126/299 R |
| 4,580,638 | 4/1986 | Jones et al. | 169/59 X |

OTHER PUBLICATIONS

PEM ALL—The Watchman PPA 27: Installation and Maintenance Manual, Sep. 25, 1969.

Walter Kidde—Sentinel: Dry Chemical Pre Engineered Fire Protection for Kitchen Hoods, Ducts, Cooking Appliances; Installation & Maintenance Model HDR-25DC, Apr. 1, 1970.

ANSUL—R-101-30 Fire Suppression System: Installation Recharge Inspection and Maintenance Manual, Apr. 15, 1976.

ANSUL—R-102 Restaurant Fire Suppression System: Installation Recharge and Maintenance Manual, Feb. 1, 1985.

Walter Kidde—Sentinel: Dry Chemical Pre-Engineered Fire Protection for Kitchen Hood & Ducts: Installation and Maintenance Manual; Model KHD 30 DC, Mar. 17, 1969.

Walter Kidde—Sentinel: Installation, Operation & Maintenance of Model HDR-50DC Automatic Link or Electric Actuation Dry Chemical Pre-Engineered Fire Protection for Kitchen Hoods Ducts & Cooking Appliances, Mar. 8, 1973.

*Primary Examiner*—Russell D. Stormer

[57] ABSTRACT

A fire extinguishing system for a cookstove or range includes a fire extinguisher mounted above a hood positioned over the cookstove or range. The fire extinguisher is connected to a pair of nozzles within the hood to dispense fire suppressant over the cookstove or range. The fire extinguisher includes an operator normally biased to the operable position, but held in the inoperable position by a cable having a plurality of fusible links distributed therein. The cable is held in tension adjacent the inner periphery of the hood. Upon the occurrence of a fire, at least one of the links separates, releasing the cable and allowing the operator to move to the operating position whereby the fire extinguisher releases the fire suppressant. A low-voltage control circuit is used to cut off the flow of electricity or gas to the stove and to sound an alarm. A battery is provided with the low-voltage control circuit so that the system will still operate if house current is interrupted.

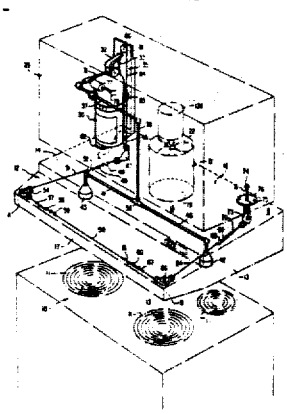

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 6, lines 48–50:

[102.] *127.* Strobe Light (12 Volt DC).

Supplier: Tandy Corporation (Radio Shack) or Amseco, Inc.

Column 5, lines 26–37:

In order to prevent the occurrence of these situations, the pipe 31 leading from the fire extinguisher is equipped with a micro switch 77 which detects when the extinguisher 30 discharges. Micro switch 77 is connected by leads 78 to the circuit of FIG. 2. Switch 77 is preferably a microswitch and is connected to a 12-volt circuit, designated generally by the numeral 100. As will be explained more specifically hereinafter, the microswitch 77 operates either a gas valve 101 or electrical switch [102] *101* via a 12-volt solenoid 103 to shut off the supply of electricity or gas when the microswitch 77 defects a discharge by the fire extinguisher 30.

Column 3, line 63–Column 4, line 37:

The cable 35, which holds the operating handle 32 in the first position against the bias of spring 33, is looped over a first pulley [38] *80* journaled on a mounting bracket [39] *81* which supports the fire extinguisher 30 on a shelf 41. The bracket 39 is rigidly attached to a wall of the cabinet 29 or to some other surface which is in fixed relation to the hood 12. The cable 35 has a first section 43 which is attached to a turnbuckle 44 that allows adjustment of the cable. A second section of the cable 46 is attached to the other end of the turnbuckle and is trained around a pulley 47 that is secured to the underside of the top 18 of the hood 12 which has a hole therethrough through which the second section 46 of the cable passes. The second section of the cable 46 exits from the pulley 47 at a right angle to the direction in which it entered the pulley and extends a distance horizontally within the hood 12 generally parallel to the side 14 of the hood. A first fusible link 48 is attached to the second length of cable 46 by an S-hook 49. The other end of the fusible link 48 is attached to a third length of cable 51 by a second S-hook 52. The third length of cable 51 is trained around a second pulley 54 in the first front corner A of the hood and emerges adjacent the front wall 17 of the hood where it is connected to a second fusible link 56 by an S-hook 57. The second fusible link 56 is connected to a fourth length of cable 58 by an S-hook 59 which extends behind the front wall 17 a distance to a fourth heat fusible link 60 to which it is connected by an S-hook 61. A fifth length of cable 64 is attached by an S-hook 63 to the fusible link 60 and extends around a third pulley 66 so as to extend along behind the side wall 13 of the hood 12. The fifth cable 64 is connected by S-hook 68 to a fourth fusible length 69 and by S-hook 70 to a sixth length of cable 71. The sixth length of cable 71 is trained around a fourth pulley 73 and emerges through the top wall 18 of the hood 12 where it is secured to a stop 74. The stop 74 prevents the fifth cable section 71 from sliding through a hole 75 in a flange 76 which is positioned on the top surface of the top 18 of the hood 12. The cable 35 and fusible links are not enclosed in conduits or housings but are exposed. However, the cable and links are ordinarily cancealed from view because they are within the hood structure.

The drawing figures have been changed as follows:

Reference numerals "78" and associated lead lines were added to FIG. 2 to point out the two leads.

AS A RESULT OF REEXAMINATION, IT HAS BEEN DETERMINED THAT:

Claims 17 and 19 are cancelled.

Claim 1, 9 and 10 are determined to be patentable as amended.

Claim 2–8, 11–16 and 18, dependent on an amended claim are determined to be patentable.

New claim 20 is added and determined to be patentable.

1. A *residental fire extinguishing* system for extinguishing stove top fires which occur on stoves that have burners, the system comprising in combination:

a hood having a top wall, first and second side walls, a front wall and a rear wall; the walls joining at first and second front corners and first and second rear corners;

nozzle means positioned within the hood and facing the stove;

fire extinguisher means connected to the nozzle means for dispensing fire suppressant material through the nozzle means;

means for operating the fire extinguisher means and means for biasing the operating means to a first position which causes the fire extinguisher to discharge the fire suppressant;

means for holding the operating means in a second position against the bias of the biasing means, wherein when the operating means is in the second position, the fire extinguishing means is prevented from discharging;

the means for holding the operating means in the second position including a cable means segmented in a plurality of sections, each section being connected to adjacent sections by fusible links;

cable support means positioned inside of the hood for training the cable means around the inside of the hood, the cable support means including a first cable support proximate the rear wall and adjacent to the first rear corner thereof, a second cable support proximate the front wall and adjacent the first front corner thereof, a third cable support proximate the front wall and adjacent the second front corner thereof and a fourth cable support proximate the rear wall and adjacent the second rear corner thereof; the cable means being free to move over at least three of the cable supports when unrestrained and being trained around the pulleys, and means for anchoring the cable means proximate the rear wall and adjacent the second rear corner of the hood, *the anchoring means being positioned outside of the hood above the top thereof,* wherein the cable means is held in tension around the inner periphery of the hood to hold the operating means in the second position whereby when there is a fire on the stove top at least one of the fusible links separates, releasing tension on the cable and allowing the operator to move from the second position to the first position under the bias of the biasing means.

9. The system of claim 6 wherein the pressure switch is connected to the circuit through a low-voltage relay which relay is connected to the means for interrupting the flow of energy from the energizing means to the burners of the stove, the relay allowing current to flow to the energy interrupting means from the power supply upon being activated by the pressure [switch] *sensor.*

10. The system of claim 6 further including alarm means for emitting a signal indicative of a fire, the alarm means being connected to the relay through the pressure [switch] *sensor* so as to sound upon activation of the pressure [switch] *sensor.*

*20. A residential fire extinguishing system for extinguishing stove top fires which occur on stoves that have burners, the system comprising in combination:*

*a hood having a top wall, first and second side walls, a front wall and a rear wall; the walls joining at first and second front corners and first and second rear corners;*

*nozzle means positioned within the hood and facing the stove;*

*fire extinguisher means connected to the nozzle means for dispensing fire suppressant material through the nozzle means;*

*means for operating the fire extinguisher means and means for biasing the operating means to a first position which causes the fire extinguisher to discharge the fire suppressant;*

*means for holding the operating means in a second position against the bias of the biasing means, wherein when the operating means is in the second position, the fire extinguishing means is prevented from discharging;*

*the means for holding the operating means in the second position including a cable means segmented in a plurality of sections, each section being connected to adjacent sections by fusible links;*

*cable support means positioned inside of the hood for training the cable means around the inside of the hood, the cable support means including a first pulley proximate the rear wall and adjacent to the first rear corner thereof, a second pulley proximate the front wall and adjacent the first front corner thereof, a third pulley proximate the front wall and adjacent the second front corner thereof and a fourth pulley proximate the rear wall and adjacent the second rear corner thereof; the cable means being free to move over at least three of the pulleys when unrestrained and being trained around the pulleys; and*

*means for anchoring the cable means proximate the rear wall and adjacent the second rear corner of the hood, the anchoring means being positioned outside of the hood above the top thereof, wherein the cable means is held in tension around the inner periphery of the hood to hold the operating means in the second position whereby when there is a fire on the stove top at least one of the fusible links separates, releasing tension on the cable and allowing the operator to move from the second position to the first position under the bias of the biasing means.*

* * * * *